United States Patent [19]

Hofmann

[11] Patent Number: 4,523,719

[45] Date of Patent: Jun. 18, 1985

[54] FUEL INJECTION NOZZLE FOR INTERNAL COMBUSTION ENGINES

[75] Inventor: Karl Hofmann, Remseck, Fed. Rep. of Germany

[73] Assignee: Robert Bosch GmbH, Stuttgart, Fed. Rep. of Germany

[21] Appl. No.: 522,769

[22] Filed: Aug. 12, 1983

[30] Foreign Application Priority Data

Oct. 13, 1982 [DE] Fed. Rep. of Germany ..... 3237882

[51] Int. Cl.[3] ..... F02M 61/06

[52] U.S. Cl. ..... 239/533.12

[58] Field of Search ..... 239/533.2–533.12, 239/584

[56] References Cited

U.S. PATENT DOCUMENTS 2,927,737 3/1960 Zeuch et al. ..... 239/533.3

4,106,702 8/1978 Gardner et al. ..... 239/533.3

4,213,568 7/1980 Hofmann ..... 239/533.4

FOREIGN PATENT DOCUMENTS 1005355 9/1965 United Kingdom ..... 239/533.3

*Primary Examiner*—Andres Kashnikow

*Attorney, Agent, or Firm*—Edwin E. Greigg

[57] ABSTRACT

A fuel injection nozzle for internal combustion engines, having a valve seat that is part of the housing and a valve needle, which has a conical throttling pintle, which during a first partial stroke of the valve needle dips into a conical injection port. The valve seat is formed inside the injection port and the sealing face or sealing edge of the valve needle merges in an unstepped manner with the throttling pintle, the conical angle of which is only slightly larger than the conical angle of the injection port. As a result of this disposition, a sealed closure of the injection port is attained, and carbonization of the throttle gap is substantially avoided.

4 Claims, 2 Drawing Figures

FUEL INJECTION NOZZLE FOR INTERNAL COMBUSTION ENGINES

BACKGROUND OF THE INVENTION

The invention is based on a fuel injection nozzle for internal combustion engines. Such injection nozzles are preferably used in Diesel engines having divided combustion chambers. With these injection nozzles, the course of injection can be modulated within wide limits in terms of the fuel quantity, the fuel pressure and the shape of the injection stream and can thus be adapted to the requirements of the engine. One disadvantage with these nozzles, however, which are also known as throttling pintle nozzles, is that as a result of deposits left in the throttle gap formed between the throttling pintle and the wall of the injection port, the cross section and the geometry of the throttle gap varies over the course of time so that the exhaust gas composition, the fuel consumption and other engine data are undesirably altered as well.

It is true that in a known injection nozzle of the type discussed above (U.S. Pat. No. 4,213,568 issued July 22, 1980), the throttling pintle and a first segment of the injection port are realized in conical shape. However, what is intended with the nozzle disclosed in that patent is primarily for the cross section of the throttle gap to enlarge even during the first portion of the valve needle stroke, so that the quantity of fuel passed therethrough will be adapted even in the partial-load range to the power requirement prevailing at that time. However, even in this embodiment the throttle gap can become plugged by matter precipitating out of the combustion gases, because when the valve is closed a difinite throttle gap still exists which extends back as far as the valve seat. Furthermore, the flow of fuel is diverted in the vicinity of the throttling pintle, the result of which may be undesirable separations of the fuel flow from the surrounding walls.

OBJECT AND SUMMARY OF THE INVENTION

The apparatus according to the present invention has the advantage over the prior art that when the valve is closed, the throttling pintle fills up the injection port virtually completely, and the residual gap remaining at the outlet of the injection port is so narrow that carbonization is for the most part avoided.

It is particularly advantageous if the conical angle of the injection port is constant over its entire length. As a result, the fuel flow is not diverted in the vicinity of the throttling pintle, and therefore no disadvantageous separations of the fuel flow from the surrounding wall occur.

Satisfactory sealing of the valve seat in the closing position of the valve needle is attained if the segment of the valve needle preceding the throttling pintle is likewise realized in a conical shape, the conical angle of which is smaller than that of the injection port, and if a sealing edge is formed at the transition from this segment to the throttling pintle, this edge cooperating with the valve seat which is part of the housing.

For the sake of improved formation and guidance of the fuel stream, a stream-forming pintle which in the closing position of the valve needle protrudes from the injection port may be mounted on the throttling pintle.

In order to attain a clearly defined transition during the course of injection from a pre-injection phase to a main injection phase and to prevent overly rapid opening of the valve needle, it is furthermore proposed in accordance with the invention that the force of the closing spring of the valve needle have a course which either increases progressively or, preferably, increases abruptly following a first partial stroke of the valve needle.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
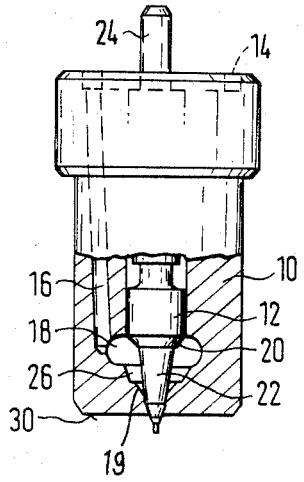
FIG. 1 shows a nozzle body of an injection nozzle in a side view and partially in section.
Figure 2:
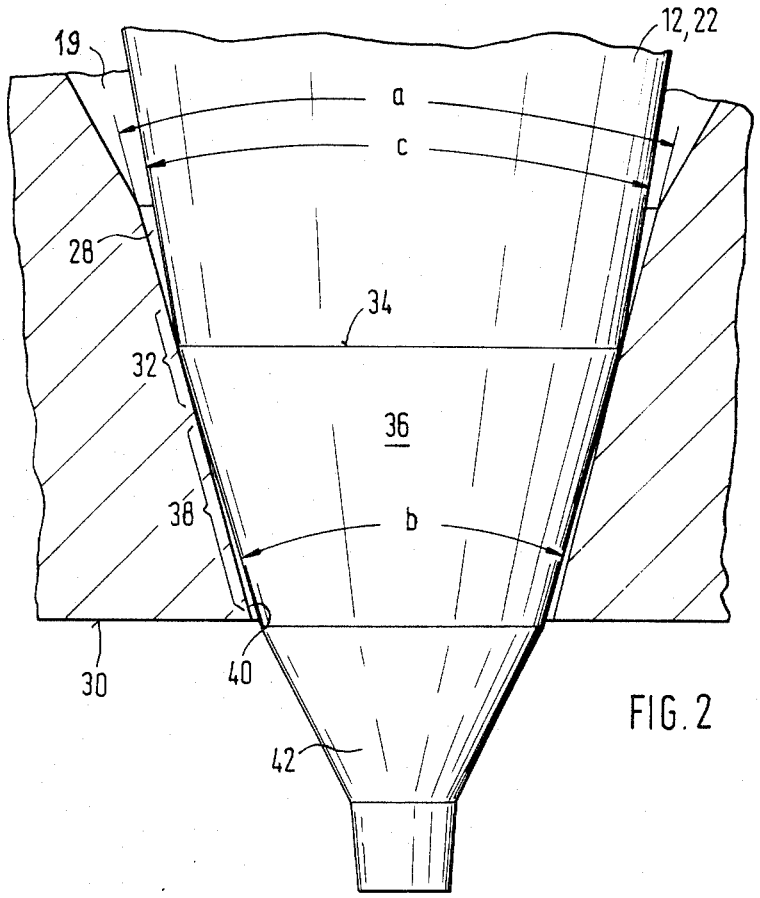
FIG. 2, on an enlarged scale, shows a detail of the nozzle body of FIG. 1.

The injection nozzle has a nozzle body 10, in which a valve needle 12 is displaceably supported. In the upper end face of the nozzle body 10, an annular groove 14 is provided, from which a bore 16 leads into a pressure chamber 18. In the vicinity of the pressure chamber 18, the valve needle 12 is provided with a compression shoulder 20 at the transition to a stepped needle segment 22. This needle segment 22 cooperates with a valve seat on the nozzle body 10, as will be described in detail below. The nozzle body 10 can be clampled firmly, in a known manner by means of a threaded nut to a nozzle holder (not shown), which contains a fuel inflow conduit corresponding with the annular groove 14 and also contains a closing spring assembly, which acts via a pressure piece upon a pintle 24 of the valve needle 12.

The nozzle body 10 has a stepped, conical bore 26, which begins at the compression chamber 18 and the stepped bore 26 is joined by a downstream conical section 19 which leads into an injection port 28, which has its outlet on the end rim 30 of the nozzle body 10 toward the combustion chamber. The injection port 28 joins conical section 19 with an angular transition, and is likewise conical in embodiment and is provided over its entire length with a constant conical angle a which angle is less than the conical angle of conical section 19. A middle region 32 of the injection port wall serves as the valve seat for the valve needle 12, which has a sealing edge 34 cooperating with this region of valve seat 32. The sealing edge 34 is positioned at the transition of the conical needle part 22 to an adjoining needle part 36, the conical angle b of which is larger by approximately one degree than the conical angle a of the injection port 28. The conical angle c of the needle part 22 is smaller than the conical angle a of the injection port 28.

A region 38 adjoins the region or valve seat 32 of the injection port 28, and in the closing position of the valve needle 12 the needle part 36 extends within this region 38. This needle part 36 has the function of the throttling pintle of conventional throttling pintle nozzles and will therefore henceforth be called the throttling pintle 36. In the closing position of the valve needle 12, the throttling pintle 36 fills up the region 38 of the injection port 28 except for a very narrow throttle gap 40, which tapers to nothing toward the valve seat 32 and which is the result of the different conical angles a and b of the injection port 28 and the throttle pintle 36. A stream forming pintle 42 adjoins the throttling pintle 36, and in the closing position of the valve needle 12 this stream forming pintle 42 protrudes out of the nozzle body 10.

The injection nozzle shown functions practically like a conventional throttling pintle nozzle. At the beginning of an injection event, the sealing edge 34 of the valve needle 12 rises from the valve seat 32 and at first opens up a throttled passage between the injection port wall and the throttling pintle 36, through which a pre-injection quantity of the fuel is ejected. After a predetermined partial stroke of the valve needle 12, the throttling pintle 36 has emerged upward out of the segment 38 of the injection port 28 to such an extent that a throttling effect no longer exists, and the primary injection quantity of the fuel can pass through. At the end of an injection event, a closing spring assembly in the nozzle holder guides the valve needle 12 back into the closing position shown. To prevent the valve needle 12 from opening too rapidly, the force of the closing spring assembly preferably has a progressively increasing course, or one which increases abruptly after a first partial stroke of the valve needle 12. This can be attained in a known manner by the disposition of a support piston, subjected to the fuel, of a single closing spring, or by the disposition of a second spring, which is put into play additionally, or taken out of play, following the first partial stroke of the valve needle.

With the described disposition, the advantage is attained that in the closing position of the valve needle 12, the injection bore 28 is filled up virtually completely by the valve needle or by the throttling pintle 36, thus substantially avoiding carbonization of the throttle gap 40. Furthermore, the fuel flow in the injection port 28 is not diverted, so that a separation of the flow from the surrounding walls does not occur. In order to keep the injection stream as tight as possible, the outlet cross section of the injection port 28 located in the plane of the end wall 30 should be kept as small as possible. In a practical exemplary embodiment, a diameter of 1.25 mm is selected for the outlet cross section. For the conical angle a of the injection port 28, angles of from 15° to 30° are proposed. Based on these figures, a diameter can be provided for the valve needle 12 which is smaller than the diameter of conventional realizations. The result is also that the masses being moved are smaller, and there is less strain on the valve seat.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection nozzle for internal combustion engines comprising a housing, a bored nozzle body in said housing which is part of said housing including a conical portion which joins with and is upstream of a conical injection port, said injection port including a valve seat, a reciprocable valve needle received in said bored nozzle body arranged to open in opposition to fuel flow and against a closing force, said valve needle having a conical segment thereof having a sealing edge cooperating with said valve seat and adjoining this edge having a conical throttling pintle extending into said injection port, said valve seat being formed on the nozzle body along said injection port, said segment of the valve needle having the sealing edge merging in a smooth angular manner with the throttling pintle, and the conical angle of the throttling pintle being greater by a maximum of 1.5 degrees than the conical angle of the injection port.

2. A fuel injection nozzle as defined by claim 1, in which the injection port has a constant conical angle over its entire length.

3. A fuel injection nozzle as defined by claim 2, in which the segment of the valve needle preceding the throttling pintle is likewise realized in conical fashion, the conical angle of this segment being smaller than the conical angle of the injection port and said sealing edge cooperating with the valve seat is at the transition of said segment to the throttling pintle.

4. A fuel injection nozzle as defined by claim 3, in which a stream forming pintle is mounted on the throttling pintle which in the closing position of the valve needle emerges out of the injection port.

* * * * *